US010143932B2

(12) United States Patent
Jensen

(10) Patent No.: US 10,143,932 B2
(45) Date of Patent: Dec. 4, 2018

(54) BUILDING PLATE FOR A TOY BUILDING SET AND A TOY BUILDING SET INCLUDING SUCH BUILDING PLATE

(71) Applicant: LEGO A/S, Billund (DK)

(72) Inventor: Kurt Jensen, Vejle (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 15/036,549

(22) PCT Filed: Nov. 28, 2014

(86) PCT No.: PCT/DK2014/050406

§ 371 (c)(1),
(2) Date: May 13, 2016

(87) PCT Pub. No.: WO2015/078479

PCT Pub. Date: Jun. 4, 2015

(65) Prior Publication Data

US 2016/0317940 A1 Nov. 3, 2016

(30) Foreign Application Priority Data

Nov. 28, 2013 (DK) ..... 2013 70724

(51) Int. Cl.
*A63H 33/08* (2006.01)

(52) U.S. Cl.
CPC ..... *A63H 33/086* (2013.01)

(58) Field of Classification Search
CPC ..... A63H 33/08; A63H 33/42; A63H 33/086
USPC ..... 446/106, 108, 116, 117, 118, 120, 122, 446/124, 125, 126, 128
See application file for complete search history.

(56) References Cited

U.S. PATENT DOCUMENTS 1,531,542 A * 3/1925 Cogshall ..... A63H 33/084 273/157 R
2,119,921 A 6/1938 Levy
2,619,829 A * 12/1952 Tatum ..... E04B 2/14 446/127
4,270,303 A 6/1981 Xanthopoulos et al.
5,215,490 A 6/1993 Szoradi
5,709,304 A 1/1998 Credle
5,810,639 A 9/1998 Liu
(Continued)

FOREIGN PATENT DOCUMENTS

CN 2466726 Y 12/2001
CN 1334752 A 2/2002
(Continued)

OTHER PUBLICATIONS

International Search Report issued in corresponding international application No. PCT/DK2014/050406, dated Mar. 18, 2015.
(Continued)

*Primary Examiner* — Vishu Mendiratta
(74) *Attorney, Agent, or Firm* — Day Pitney LLP

(57) ABSTRACT

A building plate 1 *a*, 1 *b*, 1 *c* for a toy building set is provided, said building plate having a bracket plate 5 and a complementarily configured socket 7 to the effect that several building plates can be interconnected to form a larger building plate by mounting of the bracket plate 5 on a building plate 1 *b* in a socket 7 on another building plate 1 *c*.

9 Claims, 2 Drawing Sheets

(56) References Cited

U.S. PATENT DOCUMENTS

Figure 1:
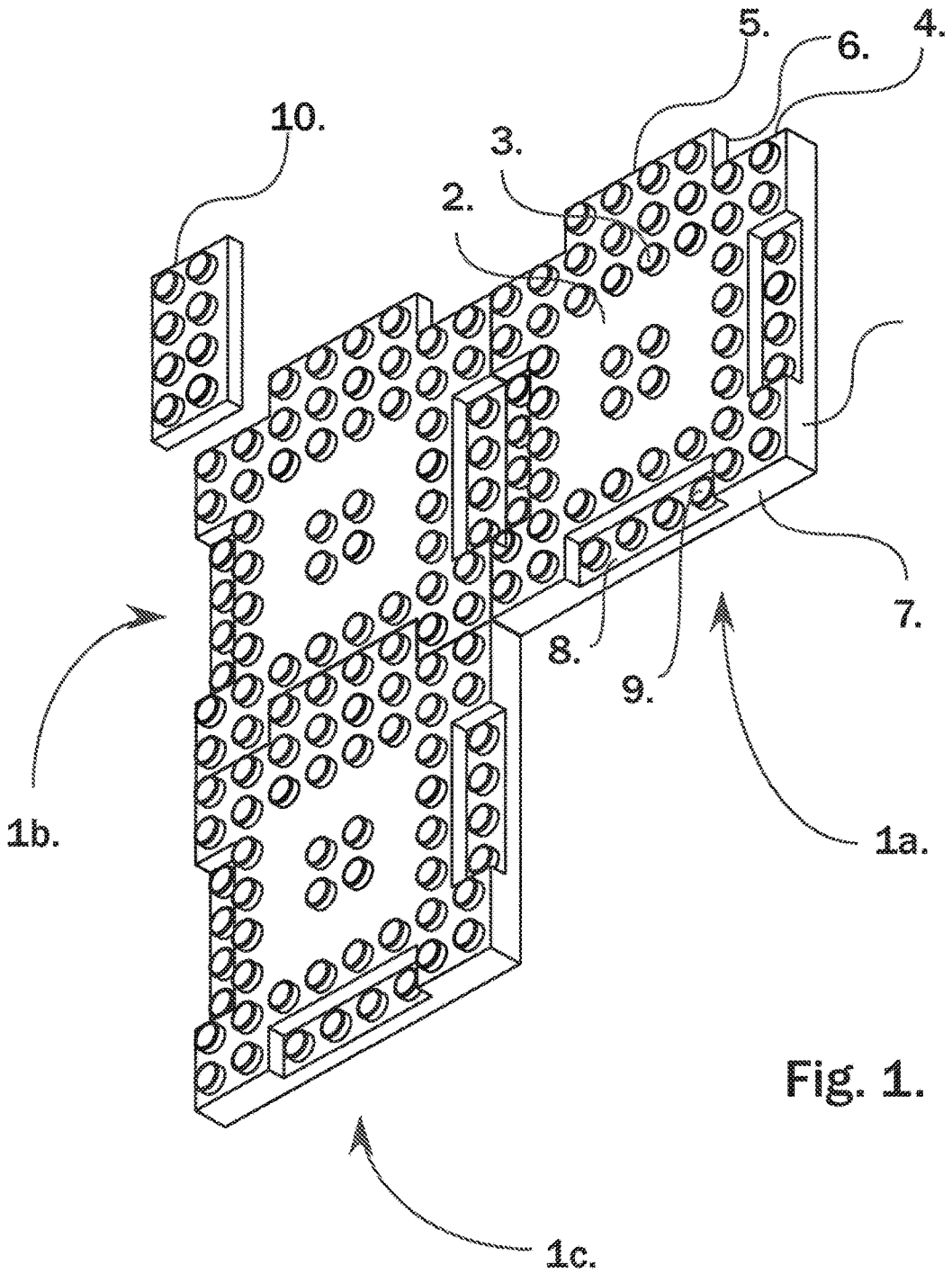

| | | | | |
|---|---|---|---|---|
| 6,050,044 | A * | 4/2000 | McIntosh | A63H 33/086 446/124 |
| 6,186,856 | B1 | 2/2001 | Chen | |
| D731,596 | S * | 6/2015 | Jensen | D21/491 |
| 2011/0061972 | A1 | 3/2011 | Parvizian et al. | |
| 2013/0178130 | A1* | 7/2013 | Balint | A63H 33/065 446/120 |

FOREIGN PATENT DOCUMENTS

| | | | |
|---|---|---|---|
| CN | 1359308 | A | 7/2002 |
| CN | 2503957 | Y | 8/2002 |
| CN | 200957290 | Y | 10/2007 |
| CN | 101132842 | A | 2/2008 |
| DE | 1108600 | B | 6/1961 |
| EP | 2258457 | A1 | 8/2010 |
| FR | 2223957 | A5 | 10/1974 |
| GB | 1442602 | A | 7/1976 |
| JP | 2002-521161 | A | 7/2002 |
| JP | 2003-503168 | A | 1/2003 |
| JP | 2012-191998 | A | 10/2012 |
| WO | 1997/018875 | A1 | 5/1997 |
| WO | 2001/002069 | A1 | 1/2001 |

OTHER PUBLICATIONS

Written Opinion of the International Searching Authority issued in corresponding international application No. PCT/DK2014/050406, dated Mar. 18, 2015.

SIPO's First Office Action together with Search Report, issued in corresponding Chinese application No. CN201480065096.8, dated Apr. 12, 2017.

Notification of Reasons for Refusal, issued in corresponding patent application No. JP 2016-534952, dated Jul. 13, 2018.

Machine Translation for Notification of Reasons for Refusal, issued in corresponding patent application No. JP 2016-534952, dated Jul. 13, 2018.

* cited by examiner

BUILDING PLATE FOR A TOY BUILDING SET AND A TOY BUILDING SET INCLUDING SUCH BUILDING PLATE

CROSS-REFERENCE TO RELATED APPLICATIONS

This application is the U.S. National Stage Application of International Application No. PCT/DK2014/050406, filed on 28 Nov. 2014, and published on 4 Jun. 2015 as WO 2015/078479 A1, which claims the benefit of priority to Danish Patent Application Serial No. PA 2013 70724, filed on 28 Nov. 2013, the disclosure and teachings of which are incorporated herein by reference.

PRIOR ART

This invention relates to a building plate for a toy building set and a toy building set comprising one or more such building plates, each of said building plates comprising a body part with a plane top face on which a plurality of coupling studs are arranged in straight rows and at mutually the same distance, and a bottom face on which a number of coupling indentations are provided that are configured to be complementary relative to the coupling studs on the top face of the building plate, and wherein the body part further comprises at least a first and a second side face extending between the top face and the bottom face of the building plate.

Building plates of that type are known in many different configurations, where it is the function of the building plate to serve as fixed base for mounting of a plurality of building blocks with the purpose of building one or more structures on the building plate. Thereby the building plate ensures that there is a fixed and reinforcing support for the individual structure built on the building plate, and retention of the mutual positioning of several structures built on the same building plate. However, it is a problem in connection with those known building plates that the building plate for a given toy building set needs to be of a considerable size or top face area to be able to form a support for the structure(s) intended to be built on the building plate.

WO 97/18875, WO 01/02069, FR 2223957 teaches a toy building set by which it is possible to arrange several building plates next to each other, whereupon they are coupled by use of separate building elements mounted on or underneath the building plates. It is a problem of that toy building set that it poses restrictions to the user, since the building elements that keep the building plates together must necessarily be positioned on two building plates. The two latter of the above-mentioned documents moreover show cavities configured at the side faces of the elements, which cavities serve to receive separate building elements for coupling of the building plates.

U.S. Pat. No. 6,186,856 teaches a toy building system comprising triangular building pieces that can be interconnected to various spatial structures, and wherein each building piece is, at one corner, provided with a projecting bracket, and, at the two remaining corners, has a cup configured for interconnection with the projecting bracket on another building piece.

THE OBJECT OF THE INVENTION

In the light of the above, it is the object of the present invention to provide a building plate and a toy building set, whereby it is possible, by use of a number of building plates, to construct a coherent larger building plate, while simultaneously a higher degree of freedom is given to the user in terms of utilization and use of the remaining building blocks of a toy building set.

This is accomplished by means of a building plate or a toy building set as set forth above, and which is characterised in that, on the first side face of the building plate, a bracket plate is configured that extends substantially at right angles from the first side face, and wherein the bracket plate is configured such that it has a plane bracket top face that extends in prolongation of the plane top face of the body part, and a bracket bottom face that is configured in parallel with the bracket top face and at a given distance there below, and which bracket bottom face is provided with coupling indentations, and wherein the building plate at the second side face further comprises at least one socket, each of which comprises a plane surface which is recessed relative to the plane top face, which is configured in parallel with the plane top face and at a distance there below corresponding to the given distance between the bracket top face and the bracket bottom face, and wherein the recessed, plane surface is provided with coupling studs, and wherein the socket is configured so as to be able to receive and be interconnected with a bracket plate corresponding to said bracket plate by interconnection of the coupling indentations on the bracket bottom face and the coupling studs on the recessed, plane surface.

Thereby the building plate or each of the building plates of the toy building set thus has an integrated bracket configured on the first side face on the building plate, said bracket being mountable in a correspondingly configured socket configured on the second side face of another building plate to the effect that two building plates are thereby kept together without the use of further elements.

At the same time, the two building plates that are kept together form a combined, plane top face which thereby makes it easy for the user to build a structure on top of the building plates by use of other building blocks in the toy building system.

According to a preferred embodiment, the top face of the body part is quadrangular and further has a third and a fourth side face extending between the top face and the bottom face of the body part. Thereby a plurality of building plates can be interconnected side by side to form a combined building plate with a continuous top face.

In this context, it is advantageous if said side faces are plane, and three of the four side faces may be provided with a socket for receiving and being interconnected with a bracket plate corresponding to said bracket plate.

If all the sockets are configured alike, a high degree of flexibility is obtained since two building plates can be interconnected in several ways.

According to a preferred embodiment, the recessed, plane surface of each socket has an area and a shape which are identical to the area and shape of the bracket top face, safeguarding being thereby provided that two interconnected building plates do not have holes in the joined top face which is formed by the top faces of the two building plates.

According to a preferred embodiment, the top face of the body part of the building plates is configured to be square which yields the greatest flexibility possible in terms of construction of a combined building plate comprising a plurality of building plates.

In this context, it is advantageous if the bracket top face has a width which is smaller than the corresponding width of the first side face, and that the bracket plate and the sockets are configured centrally on each their side face. As it is, it is accomplished in this manner that it is possible to build large quadrangular building plates with an unbroken top face by use of a plurality of building plates.

According to a preferred embodiment, the coupling studs on the plane top face of the building plate are configured in the same way as the coupling studs on the recessed, plane surface on each of the sockets.

Further advantageously, a toy building set according to the invention further comprises a third building element comprising a body part having a plane top face and a bottom face on which a number of coupling indentations are provided which are configured to be complementary to the coupling studs on the recessed, plane surface of the sockets, and wherein the body part on the third building element has a height corresponding to the given distance between the bracket top face and the bracket bottom face.

If the plane top face and the bottom face of the third building element have an area and a shape that allow it to be simultaneously mounted on the coupling studs on the recessed, plane surface in two adjoining sockets, each configured on its own building plate, it is made possible to further interconnect two building plates by use of the third building element and hence without the use of the bracket on the building plates which can thereby be used for another purpose, such as interconnection with other building plates.

THE DRAWING

The invention will be described in further detail in the following and with reference to the drawing, wherein:

FIG. 1: shows a toy building set according to the invention, comprising three building plates and a building element, seen in a perspective view from above.

Figure 2:
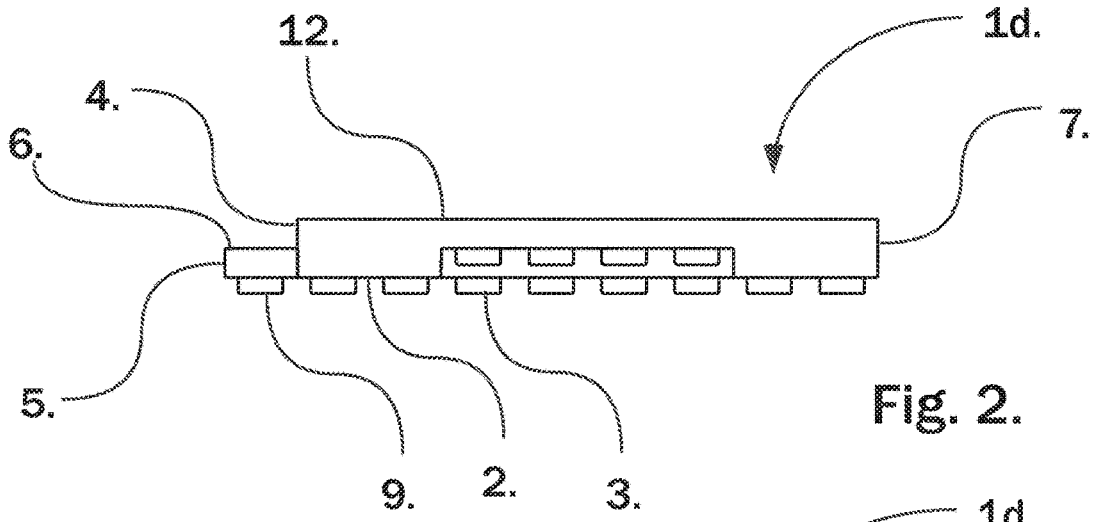

FIG. 2: shows a building plate as shown in FIG. 1, seen from one side.

Figure 3:
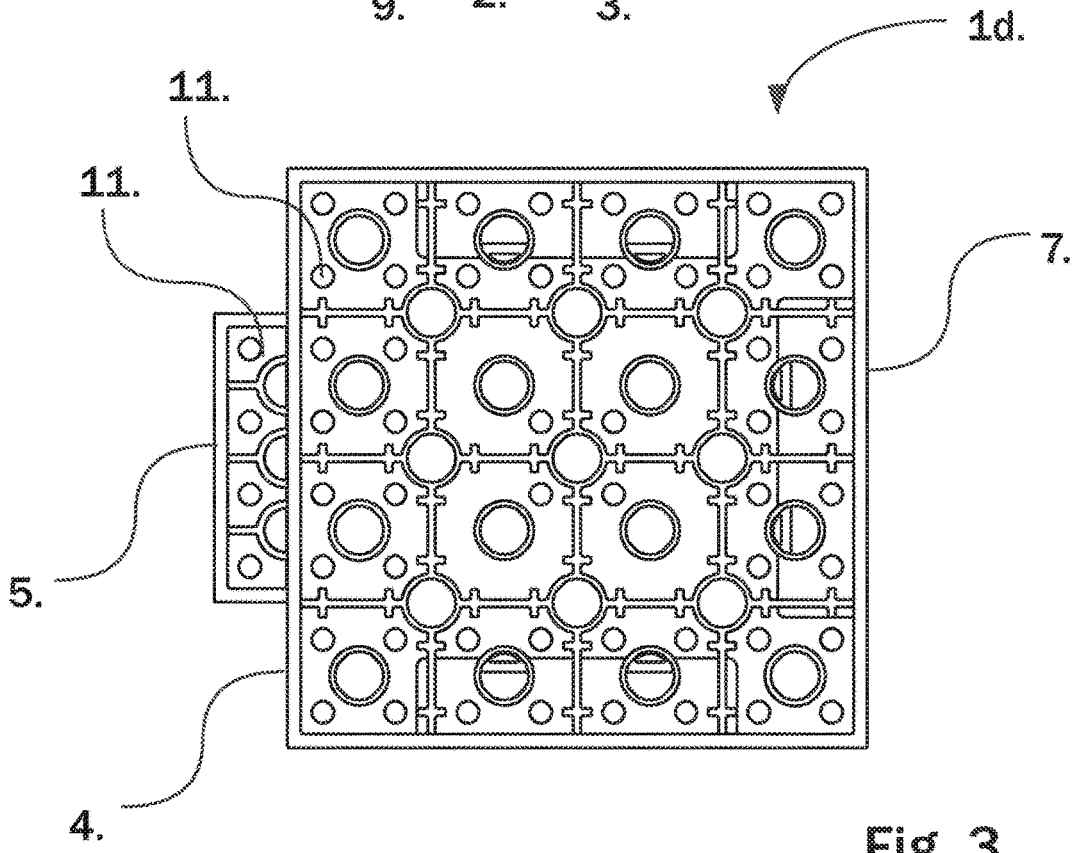

FIG. 3: shows the building plate of FIG. 2, seen from below.

DESCRIPTION OF AN EMBODIMENT

Thus, FIG. 1 shows a toy building set comprising a total of three like building plates 1*a*, 1*b*, 1*c*, each of which has a plane top face 2 on which a plurality of coupling studs 3 are arranged that can be interconnected with a number of complementarily configured coupling indentations 11 configured on the bottom face 12 of the building plate as will appear from FIG. 3. Thus, on the coupling studs 3 it is possible to build structures by means of building blocks that are provided with coupling indentations corresponding to the coupling indentations 11 shown in FIG. 3.

Each of the building plates 1*a*, 1*b*, 1*c* has a first side face 4 on which a bracket plate 5 is configured that extends from the first side face 4 in such a manner that the top face on the bracket plate 5 is flush with the top face 2 of the building plate 1*a*, 1*b*, 1*c*, and the bracket plate 5 has a bracket bottom face 6 which is in parallel with the bracket top face, but at a distance which is smaller than the height of the building plate 1*a*, 1*b*, 1*c* between the top face 2 and bottom face of the building plate 1*a*, 1*b*, 1*c*.

On another side face 7 of the building plate, a socket for the bracket plate 5 is configured. That socket is configured with a recessed, plane surface 8 on which coupling studs 9 are configured that are identical with the coupling studs 3 on the top face 2 of the building plate 1*a*, 1*b*, 1*c*.

The recessed surface 8 is recessed to a level below the top face 2 of the building plate 1*a*, 1*b*, 1*c*, corresponding to the distance between the top face and bottom face of the bracket plate 5, and the socket being moreover configured to receive the bracket plate 5 on another building plate, it is enabled that two building plates can be interconnected by mounting of the bracket plate 5 in the socket as it is also shown with building plates 1*b* and 1*c*.

As regards the building plates 1*a* and 1*c* in the shown construction, they are not combined by means of a bracket plate 5; rather they can be interconnected by use of a further building element 10 which is configured with a height, length, and width corresponding to the two adjoining sockets on the building plate 1*a* and 1*c*. To that end, the building plate 10 has a bottom face (not shown) with coupling indentations that are configured to be complementary to the coupling studs 9 in the two adjoining sockets.

FIGS. 2 and 3 show a single building plate 1*d*, corresponding to the three building plates that are shown in FIG. 1 and seen from one side and from below, respectively, wherein the coupling indentations are visible.

The invention claimed is:

1. A toy building set comprising:

a first building plate and a second building plate, the first building plate comprising:

a body part with a plane top face on which a plurality of coupling studs are arranged in straight rows and at mutually the same distance; and a bottom face on which a number of coupling indentations are provided that are configured to be complementary relative to the coupling studs on the top face of the building plate;

wherein the body part further comprises at least a first and a second side face of equal height extending between the top face and the bottom face of the first building plate;

wherein, centrally on the first side face, a bracket plate is configured that extends substantially at right angles from the first side face, the bracket plate having a quadrilateral top face with coupling studs arranged in the straight rows and at mutually the same distance as the coupling studs of the plane top face such that the top face of the bracket plate extends in prolongation the plane top face of the body part, a bottom face with coupling indentations configured to be complementary relative to and in parallel with the coupling studs of the bracket plate top face, and a bracket plate height shorter than the height of the first and second side faces of the body part, the bracket plate having a width that is shorter than the width of the first side face on which it is provided;

wherein the building plate comprises, centrally on the second side face, a socket having a quadrilateral plane surface which is recessed relative to the plane top face, which is provided with coupling studs and is configured in parallel with the plane top face and at a distance there below, the plane surface of the socket having an area and shape identical to the area and shape of the top face of the bracket plate and having a width that is shorter than the width of the second side face on which it is provided, and the socket being recessed from the top face of the body part along the side face at a distance equal to a height of the bracket plate, the socket having a bottom face with coupling indentations arranged in the straight rows and at mutually the same distance as the coupling indentations of the bottom face of the body part such that the bottom face of the socket extends in prolongation the bottom face of the body part; and wherein the socket is further configured so as to be able to receive and be interconnected with a second bracket plate of the second building plate such that the second side face of the first building plate is laterally flush with a side face of the second building plate having the bracket thereon, and wherein the bracket plate of the first building plate is further configured to be able to receive and be interconnected with a second socket of the second building plate by interconnection of the coupling indentations on the bracket plate bottom face and the coupling studs on the recessed, plane surface of the socket such that the first side face of the first building plate is laterally flush with a side face of the second building plate having the socket thereon such that the combination of the bracket plate and second socket or the interconnection of the socket and second bracket plate interconnects the first and second building plates in prolongation of the plane top face and bottom face of the first building plate and second building plate; and a third building element comprising a body part having a plane top face and a bottom face on which a number of coupling indentations are provided which are configured to be complementary relative to the coupling studs on the recessed, plane surface of the sockets, and wherein the body part on the third building element has a height corresponding to the given distance between the bracket top face and the bracket bottom face.

2. A toy building set according to claim 1, wherein the top face of the body part of the first building element is quadrangular, and has a third and a fourth side face extending between the top face and the bottom face of the body part.

3. A toy building set according to claim 2, wherein the side faces are plane.

4. A toy building set according to claim 3, wherein three of the four side faces are provided with a socket for receiving and being interconnected with a bracket plate corresponding to said bracket plate, and the sockets are configured alike.

5. A toy building set according to claim 4, wherein the top face of the body part is square.

6. A toy building set according to claim 1, wherein the recessed, plane surface on each socket has an area and a shape which are identical with the area and shape of a bracket top face.

7. A toy building set according to claim 6, wherein the bracket top face has a width which is smaller than the corresponding width of the first side face.

8. A toy building set according to claim 1, wherein the coupling studs on the plane top face of the building plate and on the recessed, plane surface on each of the sockets are the same.

9. A toy building set according to claim 1, wherein the plane top face and the bottom face of the third building element have an area and a shape that allow it to be simultaneously mounted on the coupling studs on the recessed, plane surface in two adjoining sockets, each configured on its own building plate.

* * * * *